US005165691A

United States Patent [19]

Cook

[11] Patent Number: 5,165,691

[45] Date of Patent: Nov. 24, 1992

[54] LASER GOLF CLUB PUTTER ASSEMBLY

[76] Inventor: Jon C. Cook, 7673 Sourdough Dr., Morrison, Colo. 80465

[21] Appl. No.: 781,777

[22] Filed: Oct. 23, 1991

[51] Int. Cl.[5] ..... A63B 69/36

[52] U.S. Cl. ..... 273/186.3; 116/202; 273/187.4

[58] Field of Search ..... 273/186, 194 A, 176 L, 273/192, 183 D, 193 R, 194 R, 191 R

[56] References Cited

U.S. PATENT DOCUMENTS

| | | | |
|---|---|---|---|
| 3,953,034 | 4/1976 | Nelson | 273/186 C |
| 4,251,077 | 2/1981 | Pelz et al. | 273/194 A X |
| 4,456,257 | 6/1984 | Perkins | 273/186 AA X |
| 4,934,705 | 6/1990 | Shirley | 273/176 L X |
| 4,997,189 | 3/1991 | Perkins | 273/192 X |
| 5,029,868 | 7/1991 | Cloud | 273/186 C |

*Primary Examiner*—George J. Marlo
*Attorney, Agent, or Firm*—Phillip A. Rein

[57] ABSTRACT

A laser golf club putter assembly including a laser beam assembly mounted on a basic putter club assembly to provide singular or parallel laser beams extended outwardly from a ball contact face section on a club head member. The laser beam assembly includes 1) a power supply having battery members and/or a solar panel member; and 2) a switch control assembly having a manual slide switch or an automatic motion switch member operable in an upright usage position of the basic putter club assembly to energize the laser beam assembly. A second embodiment is a handle mount laser beam assembly mounted within a handle assembly and having means thereon to automatically energize the system with a motion switch member and use a solar panel as a power source. A third embodiment of the laser golf club putter assembly is an add-on mount type having an add-on housing member with an add-on laser beam assembly contained therein operable to be connected to any available basic putter club assembly. The parallel laser beams are mounted in respective inner and outer heel portions of the club head member.

7 Claims, 2 Drawing Sheets

LASER GOLF CLUB PUTTER ASSEMBLY

PREFERRED EMBODIMENT OF THE INVENTION

In one preferred embodiment of this invention, a laser golf club putter assembly is used by a golf putter to direct and project a golf ball on a golf course green into a ball receiving hole in a unique manner.

The laser golf club putter assembly includes 1) a basic putter club assembly; and 2) a laser beam assembly mounted on the basic putter club assembly. The basic putter club assembly includes a handle assembly with a club head member mounted on a lower end thereof.

The handle assembly includes a main shaft member having a hand grasp member at an upper end thereof. The main shaft member is provided with a handle end section with a hand grasp member mounted thereon and, at a lower end of the main shaft member, is a club head connector section.

The hand grasp member is of a conventional nature and may be a wrapped leather section for ease of secure grasping by the golf player.

The club head member is provided with a shaft connector section integral with a main head member. The shaft connector section is secured to the club head connector section of the main shaft member of the handle assembly.

The main head member is provided with 1) a ball contact face section; 2) a rear weight balance section; 3) an upper wall section; and 4) a ground contact lower section of arcuate shape. The ball contact face section is provided with a central portion integral on opposite sides thereof with an inner heel portion and an outer heel portion.

The club head member resembles that of a conventional golf club putter assembly except having the laser beam assembly of this invention connected thereto.

The laser beam assembly includes a power supply assembly connected to a laser beam circuit through a switch control assembly which is all interconnected by an electrical circuit assembly. The power supply assembly can be operable through a battery member or a solar panel member to supply power directly to the switch control assembly.

The switch control assembly can be a slide switch member movable from "on" to "off" conditions or a mercury or motion switch member which is operable on removing the laser golf club putter assembly from a golf club bag and placing it in the normal usage condition which would then power the laser beam circuit through the switch control assembly.

The laser beam circuit is provided with electronics to propel spaced parallel laser beams from respective ones of the inner heel portion and the outer heel portion of the main head member of the club head member.

The parallel laser beams may be of a circular beam member or providing a projection in a rectangular beam member (in transverse cross section) depending on a final design of the laser golf club putter assembly.

The electrical circuit assembly includes 1) a ground line connected from the power supply assembly to ground; 2) a switch input line connected to the switch control assembly; 3) a switch element operable to close contact between terminal members; and 4) a switch output line interconnected to the laser beam circuit to produce projecting laser beams.

The laser beam circuit is provided with beam output lines which are connected to laser beam projections to form circular laser light beams which, in turn, are connected to group for operation of the subject laser light beams.

The laser beam circuit can be adapted to have laser beam output lines to create rectangular laser light beams (in transverse cross section) which are then connected to ground lines to complete the laser beam circuitry. The specific electrical circuitry for producing the circular laser light beams or the rectangular laser light beams are well known in the prior art.

In the switch control assembly, an alternative to the slide switch member is a mercury or motion switch member which can be connected by an inlet line to an actuator element which, then, is connected to an output line to by-pass the normal slide switch member to produce the laser light beams.

The mercury or motion switch member is utilized when the basic putter club assembly is removed from a golf club bag in its inverted condition into its upright condition which would automatically supply power from the power supply assembly to the switch output line to the laser beam circuit for operation of the circular laser light beams or the rectangular laser light beams.

It is noted that the laser light beams, whether circular or rectangular, are operable to project parallel lines which, depending on the laser light beam used whether helium, infrared, or other similar beams, may require the use of special laser beam glasses. This allows the golf player to readily and visually see the laser light beams and their singular or parallel relationship.

In a second embodiment of this invention being a handle mount option, the laser golf club putter assembly includes the basic putter club assembly having a handle mount laser beam assembly mounted thereon. The handle mount laser beam assembly includes 1) the previously described power supply assembly; 2) the laser beam circuit; and 3) the switch control assembly interconnected by the electrical circuit assembly.

The power supply assembly with its battery and/or solar panel member can be mounted within a hollow opening in the main shaft member of the handle assembly of the basic putter club assembly.

Additionally, the laser beam circuit can be mounted within the handle assembly being operably connected to the power supply assembly through the switch control assembly.

The switch control assembly would have the switch slide member mounted on an upper portion of the main shaft member and, more specifically, at the handle end section. The slide switch member can be movable from the "on" to the "off" condition or may be a mercury or motion switch member to automatically energize the laser beam circuit and electrical circuit assembly on placing in the upright normal putter usage condition.

A third embodiment of the laser golf club putter assembly is an add-on mount embodiment having an add-on housing member which has mounting holes thereon and can be secured by threaded anchor bolt members to the upper wall section of the main head member of the club head member by drilling holes therein to receive the anchor bolt members therein.

In this third embodiment, an add-on laser beam assembly would be utilized being mounted within the add-on housing member and having 1) the previously described interconnected power supply assembly; 2) a laser beam circuit; and 3) a switch control assembly interconnected by the electrical circuit assembly. In this embodiment, the switch control assembly could be either the slide switch member or the mercury or motion switch member.

OBJECTS OF THE INVENTION

One object of this invention is to provide a laser golf club putter assembly having a basic putter club assembly with a club head member with a laser beam assembly mounted therein and operable to produce and project a spaced set of parallel laser beams to aid in directing a golf ball into a ball receiving hole on a golf course green.

Another object of this invention is to provide a laser golf club putter assembly having a laser beam assembly connected to a club head member and operable to project either circular beam members or rectangular beam members from a ball contact face section of the club head member to aid in striking the golf ball to place it accurately within a ball receiving hole on a golf course green.

Still, another object of this invention is to provide a laser golf club putter assembly having a handle mount laser beam assembly with the elements thereof contained within a main shaft member of a handle assembly on a basic putter club assembly and having a switch control assembly which can be a slide switch member or a mercury or motion switch member which causes automatic energization of the system on placing the basic putter club assembly in an upright usage condition.

One other object of this invention is to provide a laser golf club putter assembly having a basic putter club assembly with an add-on mount assembly which can be easily connected to an existing basic putter club assembly to convert same to the laser golf club putter assembly of this invention.

One further object of this invention is to provide a laser golf club putter assembly having a basic putter club assembly with a laser beam assembly operable to produce parallel laser beams from a ball contact face section and can be powered by solar panel member.

Another further object of this invention is to provide a laser golf club putter assembly with a laser beam circuit to produce parallel laser beams from a club head member which can be visually observed with or without the use of laser beam glasses.

Still, one further object of this invention is to provide a laser golf club putter assembly which is economical to manufacture; sturdy in construction; manual or automatic in operation; simple to use; providing increased skill to a golf player in a putting golf situation; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
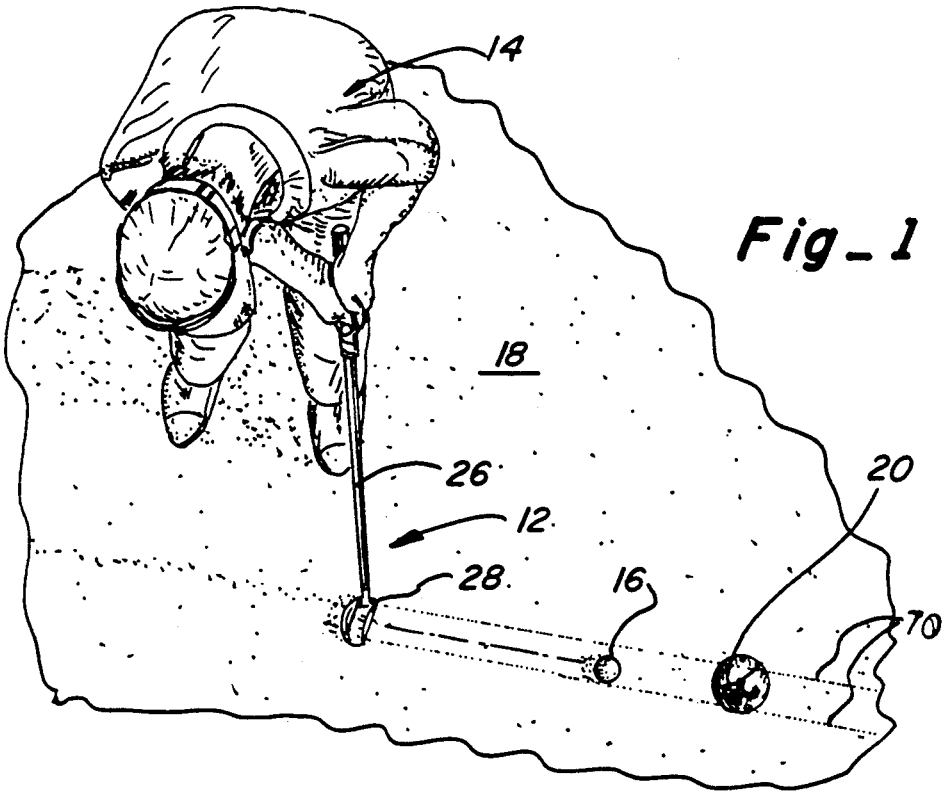
FIG. 1 is a perspective view of a golf player utilizing a laser golf club putter assembly of this invention to drive a golf ball into a ball receiving hole on a golf course green.

The following is a discussion and description of preferred specific embodiments of the laser golf putter assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a laser golf club putter assembly of this invention, indicated generally at 12, is shown and utilized by a golf player 14 in a conventional manner in order to propel a golf ball 16 on a golf course green 18 towards a ball receiving hole 20.

The laser golf club putter assembly 12 is utilized in a conventional manner in the play of a golf game and, more particularly, utilizing parallel laser beams 70 to increase the skill the of golf player 14 in placing the golf ball 16 in the ball receiving hole 20.

The laser golf club putter assembly 12 includes a basic putter club assembly 24 having a laser beam assembly 27 connected thereto.

The basic putter club assembly 24 includes a handle assembly 26 interconnected to a club head member 28 used to contact and impact the golf member 16 in a conventional manner.

The handle assembly 26 includes a main shaft member 20 having a hand grasp member 32 on an upper end thereof. The main shaft member 30 is provided with an upper handle end section 34 and a lower club head connector section 36.

The hand grasp member 32 is of a conventional nature normally having a wrapped leather section 38 for ease of grasping by the hands of the golf player 14 in a normal situation.

The club head member 28 includes 1) a shaft connector section 40 interconnected to the club head connector section 36 of the main shaft member 30; and 2) a main head member 42 integral with the shaft connector section 40. The main head member 42 includes 1) a ball contact face section 44; 2) a rear weight balance section 46; 3) an upper wall section 48; and 4) a ground contact section 50 of arcuate shape. The ball contact face section 44 includes a central portion 52 integral with an inner heel portion 54 and an outer heel portion 56.

The laser beam assembly 27 includes 1) a power supply assembly 58; 2) a laser beam circuit 60 connected by a switch control assembly 62 to the power supply assembly 58; and 3) an electrical circuit assembly 64 to interconnect the power supply assembly 58, the laser beam circuit 60, and the switch control assembly 62.

The power supply assembly 58 is connected to a battery member 66 and/or a solar panel member 68 to provide the necessary power supply which would normally by D.C. voltage.

Figure 2:
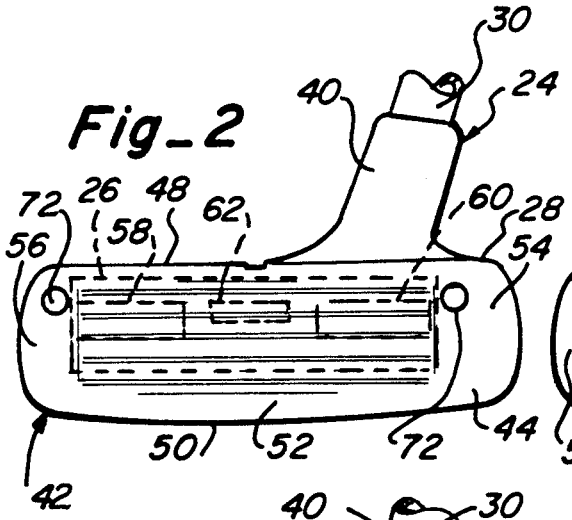
FIG. 2 is a fragmentary front elevational view of the laser golf club putter assembly of this invention.
Figure 3:
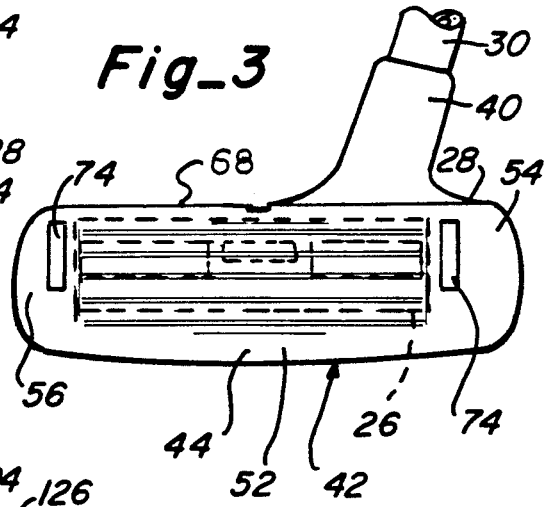
FIG. 3 is a front elevational view similar to FIG. 2 illustrating the use of rectangular laser beam members.
Figure 4:
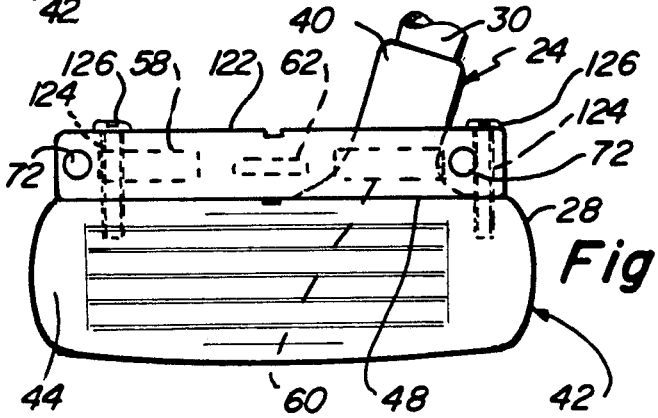
FIG. 4 is a front elevational view similar to FIGS. 2 and 3 having an add-on mount embodiment of the laser golf club putter assembly of this invention.

The laser beam circuit 60 is operable in a conventional manner to produce outwardly projecting parallel laser beams 70. The parallel laser beams 70 can be a circular beam member 72 or a rectangular beam member 74 as illustrated in respective FIGS. 2 and 3.

The laser electrical and operational circuitry in the laser beam circuit 60 is well known in the prior art and, therefore, a detailed description thereof is not necessary.

For example, laser beams from laser power pointers can be of various shapes, such as circular or rectangular, and are available as are manufactured by Lyte Optronics, Inc. of Santa Monica, Calif. which produces Model No. PLP 5000 Laser Pointers to produce circular beam members 72 or the rectangular beam members 74 utilized in the laser golf club putter assembly 12 of this invention.

Also, Lyte Optronics, Inc. produces Model No. PLS 500 to emit laser beams that are visible on a target as a bright red dot utilized for gun shooting or other such uses. Lyte Optronics, Inc. produces Model No. PLS 3 which is of a small weight and size and usable on a rifle, pistol, shotgun, or bow and arrow situation and of a size to be readily usable as mounted within the club head member 28 of the laser golf club putter assembly 12 of this invention.

Another manufacturer of laser circuits comparable to the laser beam circuit 60 is Gryphon, Inc. of Monrovia, Calif. who manufactures numerous models and sizes of lasersights to electronically produce the circular beam members 72 or the rectangular beam members 74 from the laser beam circuit 60 and, therefore, the details of the operation of the laser beam circuit of this invention is well known in the prior art and description thereof is not deemed necessary.

The switch control assembly 62 may include an "on" or "off" slide switch member 76 to energize the laser beam circuit 60 from the power supply assembly 58.

The switch control assembly 62 may include a motion switch member 78 which is operable to energize the laser beam circuit 60 on moving the basic putter club assembly 24 from an inverted condition to an upright usage condition which would close contacts in the motion switch member 78 to energize the laser beam circuit 60.

Conversely, the power to the laser beam circuit 60 would be ceased on opening of the motion switch member 78 on placing the basic putter club assembly in an inverted position.

Figure 6:
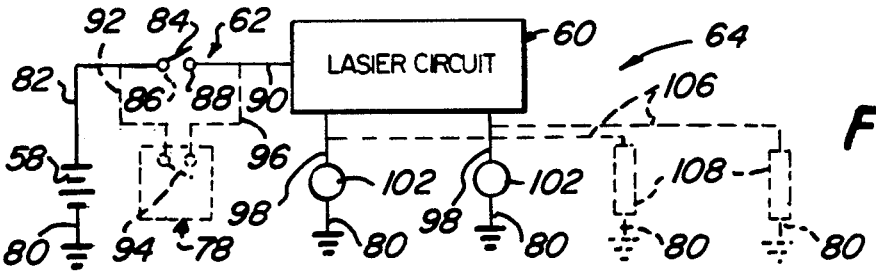
FIG. 6 is an electrical schematic of an electrical circuit assembly of the laser golf club putter assembly of this invention.

As noted in FIG. 6, the electrical circuit assembly 64 includes 1) a ground line 80 connected from the power supply assembly 58 to ground; 2) a switch input line 82 connected from the power supply assembly 58 to the switch control assembly 62; 3) a switch element 84 connected on one side to the switch input line 82 and operable in a closed condition to contact terminal members 86, 88; and 4) a switch output line 90 connected to the laser beam circuit 60.

It is noted that the motion switch member 78 is connected by an inlet line 92 from the switch input line 82 through a mercury element 94 which, in turn, is connected by an output line 96 to supply power to the laser beam circuit 60. The mercury element 94 is operable in a conventional manner to close switch contacts therein similar to terminals 86, 88 to transfer electrical power from the power supply assembly 58 to the laser beam circuit 60.

The laser beam circuit 60 has a beam output line 98 connected to circular laser light beams 102 which, in turn, are connected to ground lines 80 to complete the necessary energization of the circular laser light beams 102.

As an alternative, the laser beam circuit 60 is connected by beam output lines 106 to rectangular laser light beams 108 which, in turn, are connected to ground lines 80 to complete the circuit therethrough.

Figure 7:
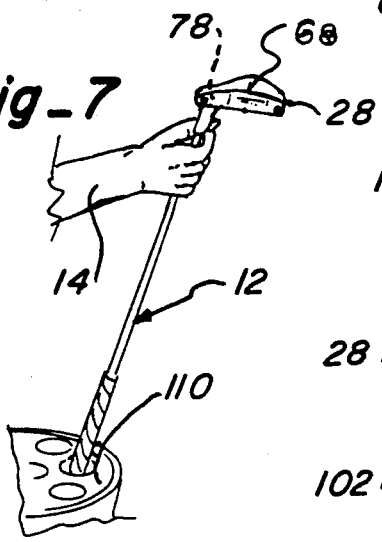
FIG. 7 is a fragmentary perspective view showing a golf player removing a laser golf club putter assembly from a golf bag utilizing a mercury or motion switch member to control operation thereof.

As noted in FIG. 7, the laser golf club putter assembly 12 may be placed within an opening in a golf club bag 110 in playing reverse condition. This causes the mercury or motion switch member 78 to open so that the laser beam assembly 27 is not energized when in a conveyance, non-usage condition.

Figure 8:
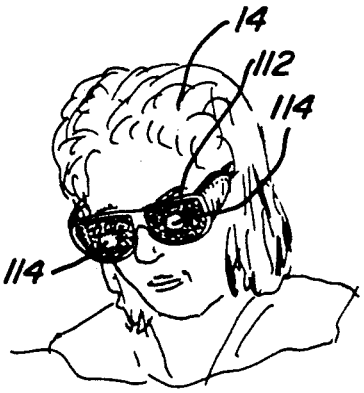
FIG. 8 is a fragmentary perspective view of a head portion of a golf player having laser beam glasses thereon.

As noted in FIG. 8, the golf player 14 may utilize laser beam glasses 112 having central optical areas 114 therein. The circular or rectangular beam members 72, 74 may be readily visible to the golf player 14 but, in certain cases, may require the use of the laser beam glasses 112 which are well known in the prior art.

Figure 5:
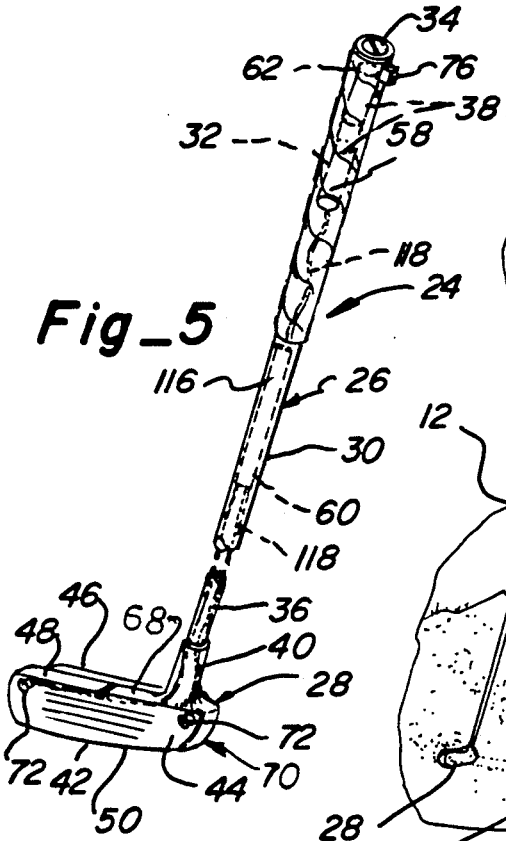
FIG. 5 is a perspective view of a second embodiment of a handle mount laser golf club putter assembly of this invention.

In a second embodiment of the laser golf club putter assembly 12 is shown in FIG. 5 which includes a handle mount laser beam assembly 116 utilizing the basic putter club assembly 24 with a handle mount laser beam assembly 116 mounted within the handle assembly 26.

The handle mount laser beam assembly 116 includes 1) the previously described power supply assembly 58; 2) the laser beam circuit 60; 3) the switch control assembly 62; and 4) all interconnected down to the laser beams 70 by an electrical connector cable 118.

In a third embodiment of the laser golf club putter assembly 12, there is an add-on mount embodiment which can be readily secured to an existing club head member 28 on the basic putter club assembly 24.

More particularly, the add-on mount embodiment includes an add-on housing member 122 having mounting holes 124 which can be secured by threaded anchor bolt members 126 mounted in drilled threaded openings in the upper wall section 48 of the club head member 28.

In this embodiment, all of the elements of an add-on laser beam assembly 130 are contained therein and having 1) the previously described power supply assembly 58; 2) a laser beam circuit 60; and 3) a switch control assembly 62 which can be a slide switch member 76 or a mercury switch member 78.

The add-on housing member 122 has the add-on laser beam assembly 130 contained thereon and easily secured by the anchor bolt members 126 to a conventionally available club head member 28.

USE AND OPERATION OF THE INVENTION

In the use and operation of the laser golf club putter assembly 12 of this invention as noted in FIG. 1, the golf player 14 grasps the handle assembly 26 and addresses the golf ball 16.

The parallel laser beams 70 are thereupon operable to be parallel to the ball contact face section 44 in which the golf ball 16 is normally hit by the central portion 52 of the ball contact face section 44 of the club head member 28.

The golf player 14 moves the laser golf club putter assembly 12 in a proper rearward direction so as to direct the golf ball 16 towards the ball receiving hole 28 in a precise, accurate manner as noted in FIG. 1.

Figure 9:
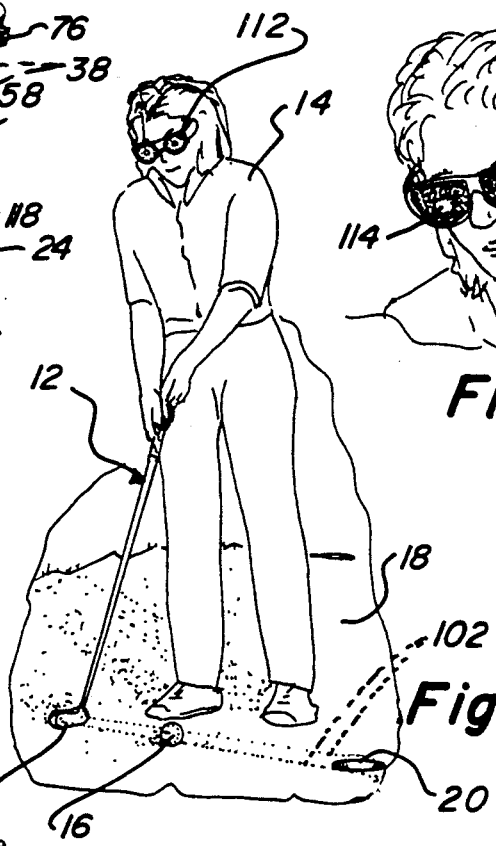
FIG. 9 is a perspective view of a golf player using the laser beam glasses to observe laser beams emitted from the laser golf club putter assembly of this invention.

Depending on the type of parallel laser beams 70 being created from the laser beam circuit 60, they may be visible without laser beam glasses 112 by the golf player 14 or, as noted in FIGS. 8 and 9, the use of the laser beams glasses 112 may be necessary to visually observe the parallel laser beams 70.

Figure 10:
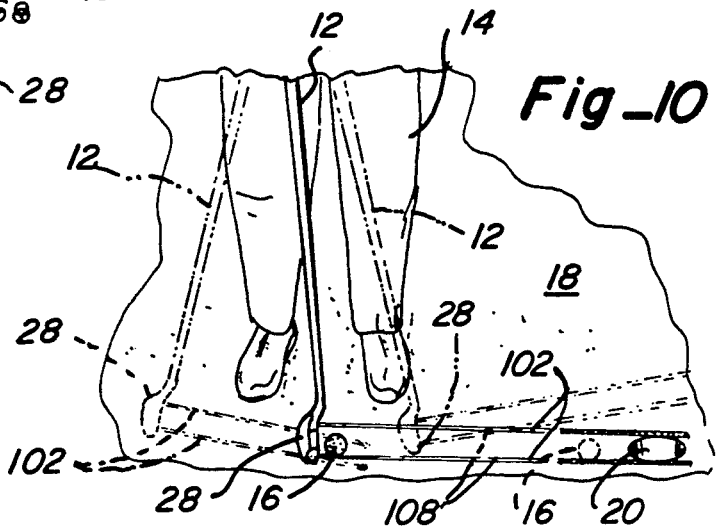
FIG. 10 is a fragmentary perspective view of a golf player showing various movements of the laser golf club putter assembly of this invention and illustrating different movements of the laser beams being emitted therefrom.

As noted in FIG. 10, normally the golf player 14 would move the club head member 28 rearwardly in order to ascertain whether a proper stroke may be obtained on the golf ball 16 in order to drop same in the ball receiving hole 20.

As noted in the back swing shown in dotted lines in FIG. 10, the circular laser light beams 72 or rectangular laser light beams 74 are operable on the backward swinging motion to contact the golf course green 18 so that the golf player 14 can ascertain whether he is moving his backstroke in a proper manner before hitting the golf ball 16.

Additionally in FIG. 10, it is noted in dotted lines produced by the movement of the laser golf club putter assembly 12 rearwardly, teaches the golf player 14 to observe movement of the parallel laser beams 70 to ascertain whether the golf player 14 is following through with a proper golf putting stroke to propel the golf ball 16 in the ball receiving hole 20.

The laser golf club putter assembly 12 is operable through the parallel laser beams 70 to aid in putting skills as the path of movement of the laser golf club putter assembly 12 during the putting operation leaves a visible path of movement before contact and forward follow through motion of the laser golf club putter assembly 12 which should substantially decrease the total golf score to be obtained by the golf player 14. It is well known that putting on the golf course green 18 is a major element in winning the game of golf.

The laser golf club putter assembly of this invention is economical to manufacture; easy to use; operable through a slide switch member and/or a motion switch member to provide energization thereto; providing parallel laser beams which may be readily observed or observed through laser beam glasses; and substantially maintenance free.

While the invention has been described in conjunction with preferred specific embodiments thereof, it will be understood this description is intended to illustrate and not to limit the scope of the invention, which is defined by the following claims:

I claim:

1. A laser golf club putter assembly used by a golf player to impact and direct a golf ball toward a ball receiving hole on a golf course green, comprising:

a) a basic putter club assembly including a handle assembly connected to a club head member;

b) a laser beam assembly connected to said club head member operable to produce a laser beam projected from said club head member;

c) said laser beam assembly includes a power supply assembly connected through a switch control assembly to a laser beam circuit operable to energize said laser beam; and d) said switch control assembly is a motion switch member operable to energize said laser beam circuit to energize said laser beam when said basic putter club assembly is held in a predetermined position and to de-energize said laser beam circuit when placed in another predetermined position;

whereby said laser beam is a line visible to the golf player to aid in impacting the golf ball into the ball receiving hole.

2. A laser golf club putter assembly as described in claim 1, wherein:

a) said power assembly is a solar panel member.

3. A laser golf club putter assembly as described in claim 1, wherein:

a) said laser beam assembly produces a pair of spaced parallel laser beams directed from said club head member to aid the golf player in the use of said basic putter club assembly.

4. A laser golf club putter assembly as described in claim 3, wherein:

a) said parallel laser beams are rectangular beam members in transverse cross section.

5. A laser golf club putter assembly as described in claim 1, wherein:

a) said laser golf club putter assembly includes a pair of laser beam glasses to be worn by the golf player which enables observance of said beam member when said golf player needs subject laser beam glasses for observation thereof.

6. A laser golf club putter assembly as described in claim 1, wherein:

a) said club head member having a ball contact face section having a central portion integral with inner and outer heel portions;

b) said laser beam assembly produces a pair of spaced parallel laser beams therefrom; and c) a respective one of said laser beams mounted in respective ones of said inner heel portion and said outer heel portion to produce the parallel laser beams projected in a common plane from said ball contact face section.

7. A laser golf club putter assembly used by a golf player to impact and direct a golf ball toward a ball receiving hole on a golf course green, comprising:

a) a basic putter club assembly including a handle assembly connected to a club head member;

b) a laser beam assembly mounted within said handle assembly operably connected to a laser beam producer mounted in said club head member to project a laser beam therefrom;

c) said laser beam assembly includes a power supply assembly to produce electrical power therefrom; a switch control assembly connected to the power supply assembly operable to open and close electrical continuity therethrough; a laser beam circuit operable through said laser beam producer to produce said laser beam; and an electrical circuit assembly operable to interconnect said power supply assembly, said switch control assembly, and said laser beam circuit;

d) said switch control assembly having a motion switch member to selectively energize said laser beam circuit for producing said laser beams; and e) said power supply assembly is a solar panel member to produce electrical power for operation of said laser beam circuit through said switch control assembly to energize said laser beams;

whereby said laser beam is a line visible to the golf player before impacting the golf ball into the ball receiving hole.

* * * * *